US007367208B2

(12) United States Patent
Poloni et al.

(10) Patent No.: US 7,367,208 B2
(45) Date of Patent: May 6, 2008

(54) COIL WINDING METHOD FOR METAL IN BARS

(75) Inventors: Alfredo Poloni, Fogliano Redipuglia (IT); Nicola Redolfi, Mezzana (IT); Giuseppe Bordignon, Bicinicco (IT)

(73) Assignee: Danieli & C. Officine Meccaniche S.p.A. (IT)

( * ) Notice: Subject to any disclaimer, the term of this patent is extended or adjusted under 35 U.S.C. 154(b) by 184 days.

(21) Appl. No.: 10/557,126

(22) PCT Filed: May 19, 2004

(86) PCT No.: PCT/EP2004/050862

§ 371 (c)(1),
(2), (4) Date: Nov. 17, 2005

(87) PCT Pub. No.: WO2004/104237

PCT Pub. Date: Dec. 2, 2004

(65) Prior Publication Data

US 2006/0249232 A1 Nov. 9, 2006

(30) Foreign Application Priority Data

May 22, 2003 (IT) ..... MI2003A1031

(51) Int. Cl.
*C21D 8/08* (2006.01)
*C21D 9/573* (2006.01)
*C21D 9/52* (2006.01)

(52) U.S. Cl. ..... 72/201; 72/342.2; 148/654; 148/601; 266/259

(58) Field of Classification Search ..... 72/69, 72/201, 342.2; 148/541, 546, 602, 601, 598, 148/654, 661; 266/115, 259
See application file for complete search history.

(56) References Cited

U.S. PATENT DOCUMENTS

| | | | | |
|---|---|---|---|---|
| 2,756,169 | A * | 7/1956 | Corson et al. | 148/595 |
| 3,111,436 | A * | 11/1963 | McGavin | 148/663 |
| 4,146,411 | A | 3/1979 | Dewsnap et al. | |
| 4,877,463 | A * | 10/1989 | Aicher et al. | 148/644 |
| 6,096,146 | A * | 8/2000 | Poloni et al. | 148/601 |

FOREIGN PATENT DOCUMENTS

| | | |
|---|---|---|
| DE | 1212571 | 3/1966 |
| EP | 0 496 726 | 7/1992 |
| EP | 0 882 804 | 12/1998 |
| GB | 1 266 721 | 3/1972 |
| GB | 1471740 | 6/1973 |
| GB | 1 351 423 | 5/1974 |
| WO | WO 00/25951 | 5/2000 |

* cited by examiner

*Primary Examiner*—Dmitry Suhol
(74) *Attorney, Agent, or Firm*—Stetina Brunda Garred & Brucker

(57) ABSTRACT

Coil winding method for steel bars providing, at the outlet of the rolling mill (2), cooling stages by means of WB (4', 4'', 4''') and equallsation in air so as to perform "soft" hardening on the bar which generates a microstructure consisting, on the surface, of martensite and bainite and, in the center, of ferrite and pearlite, and winding of the bar in the form of a compact coil by means of a coil winder (5). In the position wound on the coil, the bar cools slowly with tempering of the bainite and martensite formed on the surface. This is followed by a straightening stage, jo performed during the coil unwinding phase, and a natural ageing stage, maintaining the bar at ambient temperature.

2 Claims, 3 Drawing Sheets

COIL WINDING METHOD FOR METAL IN BARS

FIELD OF THE INVENTION

The present invention refers to a coil winding process for metal bars.

STATE OF THE ART

The problems relating to cooling of rolled products coming out of the rolling mill, said cooling also having the function of ensuring that the products have optimal structural and quality characteristics, both superficial and internal, are known.

A cooling process according to the known technique is performed in the following way by means of a system illustrated in FIG. 1. This is a rapid cooling process which is applied to the product coming out of the last lamination stage; FIG. 2 shows the cooling curve for this type of product.

In the element indicated by QTB (Quenching Treatment Bar) in FIG. 1 the temperature of the rolled product is lowered, by quenching in a water box, in order to exceed, in the surface areas of the bar, a certain cooling speed, or critical speed, above which crystalline microstructures are obtained characterised by a high level of hardness and resistance.

With this rapid cooling, which performs surface hardening of the product, a surface area is obtained in which very fine martensitic structures are present typical of the hardening treatment. Said martensitic structures are obtained as a result of suppression of the diffusive transformation of the austenite due to the rapid drop in temperature.

According to the treatment, conventionally called QTB, after the rapid cooling phase the rolled product undergoes a phase of equalisation in air in which the heat of the centre spreads towards the surface areas, thus ensuring uniform temperature of the whole section. At the outlet of the QTB, the bars treated in this way are then discharged onto a cooling bed where the temperature at all points of the product begins to drop and the tempering process takes place. During these last two phases, the hardness of the surface areas is reduced, at the same time obtaining a substantial increase in toughness. The speed at which the temperature drops is generally high enough to limit the negative effects of excessive tempering on the surface mechanical characteristics of the product.

With this process of the prior art, the right compromise is achieved between mechanical resistance and toughness of the product in order to comply with the minimum mechanical characteristics established by the various national and international standards. Once discharged onto the bed and cooled to ambient temperature, the material is ready for use (finished product).

If the metal bar is directly wound in a compact form on a coil winder instead of being discharged onto the bed, the compactness of the coils results in extremely slow non-uniform cooling between the centre and the surface of the coil, leading to non-uniformity of the structural and mechanical characteristics of the coiled product. Furthermore, the tempering consequent upon the slow cooling of the coil often involves excessive and unacceptable deterioration of the mechanical properties of the material.

In order to exploit the considerable advantages deriving from immediate winding of the rolled product (coil) in compact form and at the same time avoid the undesired effects of excessive tempering, EP 1.126.934 proposes another cooling process controlled and accelerated by means of a series of water boxes, abbreviated to WB, positioned downstream of the last rolling stand. EP '934 considers two classes of products differentiated in that they have (first class of products) or do not have (second class) a hardened surface crown at the end of the treatment. At the outlet of the last stand, the products of the first class undergo cooling at a speed higher than the critical hardening speed and the subsequent cooling operations are calibrated in order not to modify the thickness of the hardened layer; at the end of this process, said products, in the form of compact coils, have mechanical and structural characteristics substantially the same as those of the corresponding products obtained by the bed process. When said coils of rolled metal hardened on the surface are employed by the end user, they are unwound and straightened in appropriate machines, already known in the state of the art; the straightening operation involves work hardening of the material which determines an increase in the mechanical characteristics, so that there is the risk of the yield stress of the material hardened on the surface and subjected to straightening exceeding the limit values permitted by the current regulations.

This invention is designed to overcome this problem and to obtain further advantages as illustrated below.

SUMMARY OF THE INVENTION

The main aim of the present invention is to overcome the drawbacks referred to ensuring that a material with optimal structural characteristics is obtained.

Said aims are achieved by means of a coil winding method for metal in bars.

Said coil winding method is performed, downstream of the last rolling stand, according to the following stages:

quenching of the bar in a first water box and subsequent equalisation in air to a temperature of 800-880° C. In this phase the surface temperature always remains above that of formation of the martensite (Ms), no microstructural modifications to the material occur and both the surface and the centre of the bar remain in the form of austenite only;

the bar is subsequently cooled in another two water boxes (or more than two depending on the plant throughput), positioned at a certain distance from one another; in this phase the surface temperature is lowered to below that of the Ms and the last cooling stage is followed by an equalisation phase in air which brings the temperature of the rolled material to 600-700° C.; in this way a final microstructure is obtained which on the surface consists of a mixture of martensite and a large amount of lower bainite and which in the centre consists of ferrite and pearlite;

the bar is wound in the shape of an ultra-compact coil by means of a coil winder at the temperature specified above of 600-700° C.

The products treated with the process of the invention do not feature the characteristic structure of rod metal hardened on the surface, i.e. an outer ring of martensite with a centre consisting of ferrite and pearlite; in this case (specific for low carbon content) the heat treatment is defined "soft hardening" and the material (coil) produced in this way is only a semi-finished product: in fact, the final mechanical properties are obtained by combining with this soft hardening treatment (upstream of the coil winding) a mechanical deformation (unwinding and straightening by means of appropriate machines), and natural ageing at ambient temperature.

In this process the mechanical properties of the finished product are therefore obtained by means of a combination of heat treatment on the water line, provided with WB, straightening and ageing.

The heat treatment according to the invention is particularly suitable for the production of ultra-compact coils of ribbed steel rod for reinforced concrete with a yield stress of between 450 and 520 Mpa for low carbon steel.

LIST OF THE FIGURES

Further advantages that can be achieved with the present invention will become apparent, to a person skilled in the art, from the following detailed description of a particular non-restrictive embodiment of a coil winding process for metal in bars shown by way of example with reference to the following Figures, in which FIG. 1 is a diagram of a state-of-the-art bar line with QTB;

DETAILED DESCRIPTION OF THE INVENTION

Figure 1:
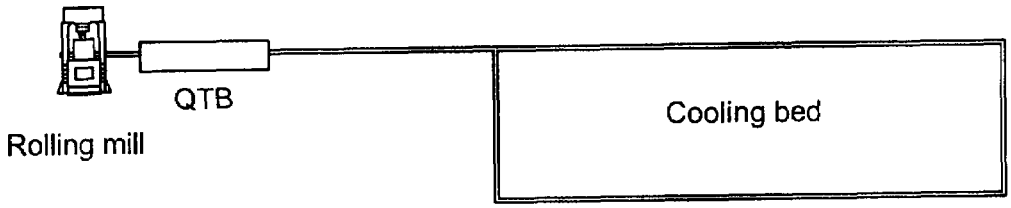
Fig. 1 (Prior Art)
Figure 2:
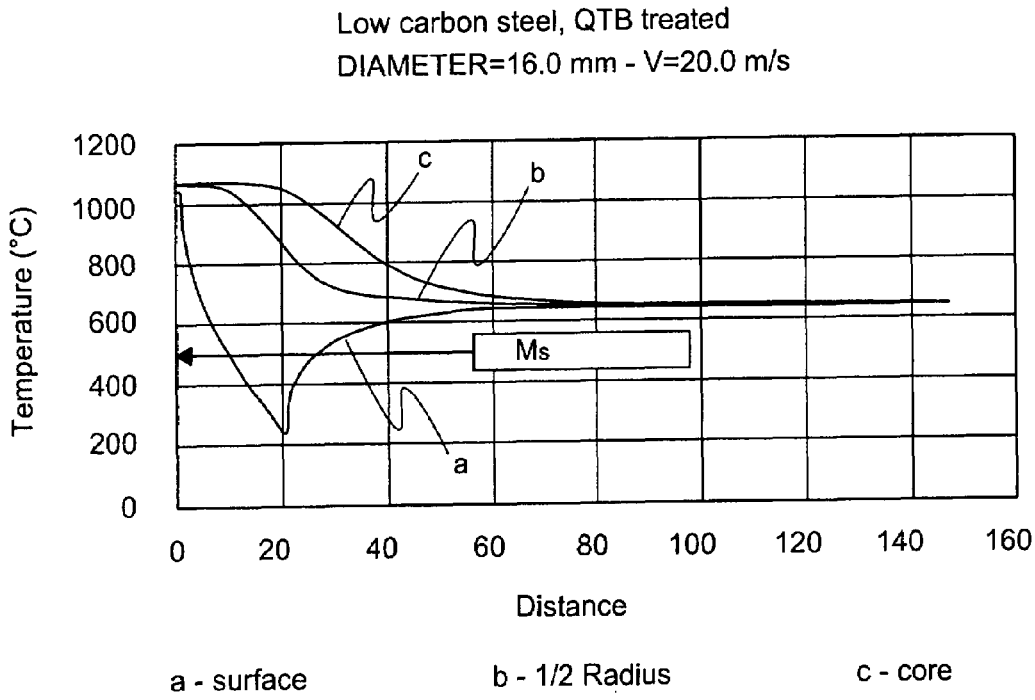
FIG. 2 illustrates the cooling curve of bars subjected to heat treatment with the line of FIG. 1.
Figure 3:
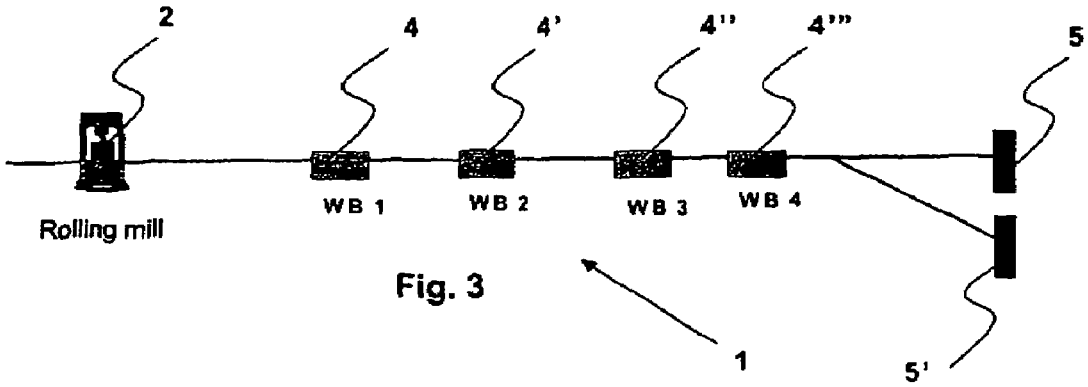
FIG. 3 is a diagram of a bar line on which the process of the invention is performed.
Figure 4:
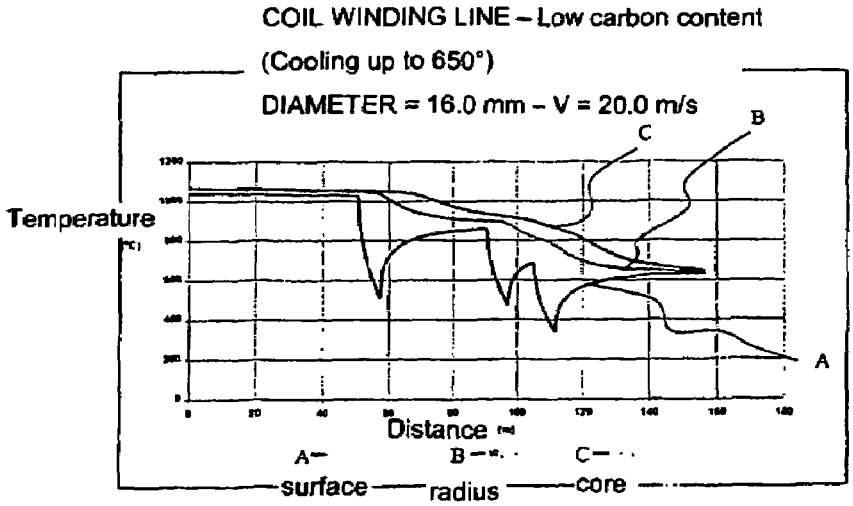
FIG. 4 illustrates the cooling curve of bars subject to heat treatment according to the invention with the line of FIG. 3.

With particular reference to FIGS. 3 and 4, a coil winding method for metal bars according to the invention provides for a coil winding line, indicated overall by reference number 1, positioned downstream of a rolling mill 2. The coil winding line comprises a series of water boxes (WB) the number of which can be defined according to the material to be treated and the plant throughput. Downstream of the last water box, one or more devices are provided for winding the material treated, for example on reels.

The process in the first part of the line is performed according to the following stages, in the case of low carbon steel for a plant with throughput of 70÷90 t/h.

At the outlet of the rolling mill 2, in the WB 4' the bar is cooled to a temperature higher than the temperature initiating the formation of martensite Ms; the temperature depends on the metallurgical composition of the material to be treated. Subsequently an equalisation stage in air is performed bringing the temperature to between 800 and 880° C., which is defined as "equalised" temperature. In this phase no microstructural modifications occur, and both the surface and the centre of the bar remain completely in the form of austenite.

The bar is then cooled in the WB 4", 4'", with the surface dropping below the Ms temperature, and equalised, after the last stage, to 600-700° C. so as to obtain a final microstructure consisting on the surface of a mixture of martensite and a large amount of lower bainite and in the centre of ferrite and pearlite.

The bar is then wound in the form of an ultra-compact coil by means of a coil winder 5, at the temperature specified above of 600-700° C.

In the position wound on the reel, the bar cools slowly due to the compactness of the coil loops which determines a slow loss of heat causing tempering of the bainite and martensite formed on the surface.

The next stage consists in unwinding and straightening of the coil, which is performed via specific machines. Lastly, natural ageing is performed, maintaining the bar at ambient temperature.

Since straightening followed by ageing leads to an increase in the mechanical properties, values lower than the yield stress Ys and ultimate tensile stress UTS must be scheduled on the coil as is (i.e. on the semi-finished product prior to straightening and natural ageing).

The final mechanical properties of the rolled product are therefore obtained via a combination of heat treatment on the water line, provided with WB, followed by straightening and ageing.

As an example and in order to better understand the essence of the invention, a comparison is provided below between the traditional bed process and the process according to the invention to obtain bars in compliance with the Eurmorm EN 10080 standard—Grade 450, which corresponds to the mechanical properties of the following table:

| Standard | Ys (MPa) | UTS/Ys |
|---|---|---|
| EN 10080 - Grade 450 | ≧450 | ≧1.15<br>≦1.35 |

in which:

Ys=Yield Stress;

UTS=Ultimate Tensile Stress.

The ratio between ultimate tensile stress and yield stress gives an idea of the ductility of the material.

The type of steel considered is a low carbon steel and the rolled product is a ribbed rod for reinforced concrete with diameter of 16 mm, with plant throughput of 90 t/h.

Normally to accelerate the ageing, which at ambient temperature requires a few days (approximately one week), and immediately perform the tests to determine the mechanical properties, ageing is performed at 100° C. for 1 hour as provided for by the EN 10080 standard (furnace accelerated ageing).

In the case of the heat treatment according to the invention, the results obtained are summarised in the following table.

| As is (coil) | | Straightened and aged at 100° C. for 1 hour | |
|---|---|---|---|
| Ys (MPa) | UTS/Ys | Ys (MPa) | UTS/Ys |
| 400 | 1.32 | 475 | 1.18 |

Figure 5:
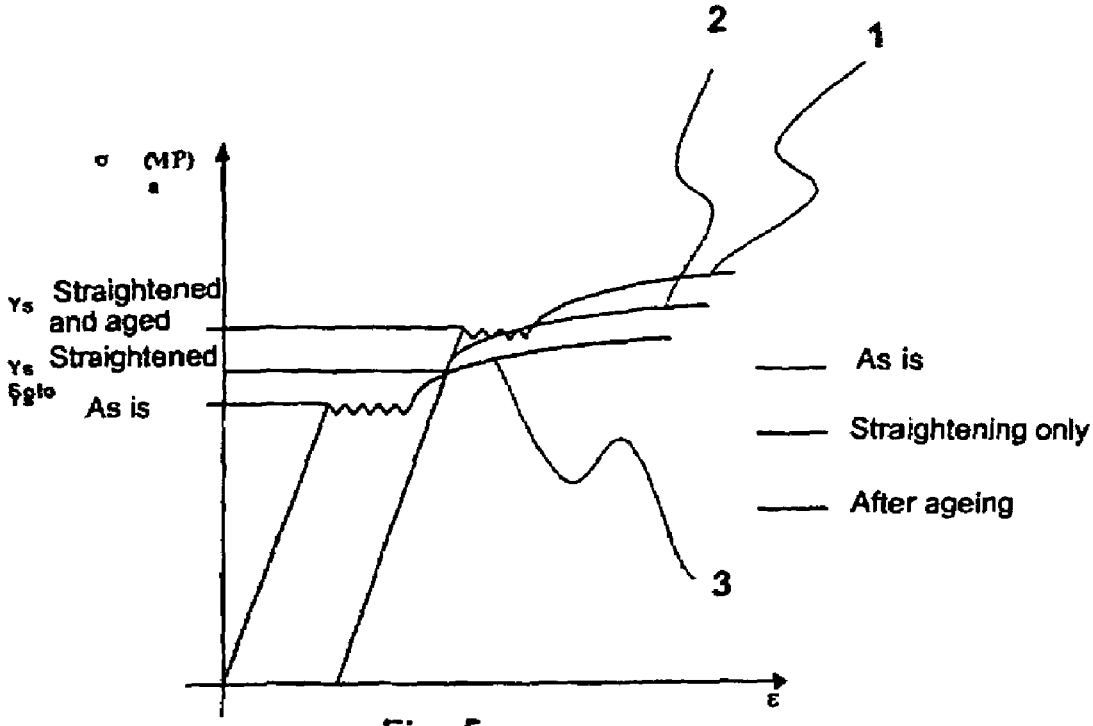
FIG. 5 illustrates graphs of stress (a) versus deformation (E) for bars subject to the process of the invention and for bars subject to known processes.

The structural properties of the product obtained are described below with particular reference to FIG. 5 which shows curves of stress (a) versus deformation (E) in 3 cases.

Curve 3 is the curve relating to the tensile stress test performed on the test piece taken from the coil as is.

During the straightening operation, the material is work hardened: there is a significant increase in the yield stress and, to a lesser extent, in the ultimate tensile stress. At the same time there is a considerable reduction in ultimate elongation.

When a test piece is subjected to the tensile stress test immediately after straightening (without any type of ageing) it behaves qualitatively like curve 2.

Following the ageing phase, natural or in a furnace, relaxation of the tension due to the straightening and a further increase in the yield stress are obtained. The test piece subjected to the tensile stress test behaves qualitatively like curve 1.

Said behaviour is due to the phenomenon of strain ageing, i.e. rearrangement of the "atmospheres", or the set of alloy components, due to diffusion, near the "displacements".

In the traditional case of QTB hardening with discharge into the cooling bed, the required mechanical characteristics (typically Ys equal to 480-490 MPa for EN 10080, Grade 450) are obtained by hardening only by QTB and subsequent tempering at an appropriate temperature, i.e. the bar discharged onto the bed is already the finished product.

Obvious advantages deriving from the production of a coil are reduced overall dimensions of the coils and optimisation of storage space in addition to easier transport. Apart from the advantages in terms of logistics and storage, the coil offers considerable unwinding reliability without scrap, guaranteed by the neat geometrical arrangement of the loops, and results in a considerable increase in unwinding speed during the work processes downstream.

A particular advantage of the product obtained with the process according to the invention compared to the product obtained in a cooling bed consists in the fact that by means of the straightening parameters it is possible to "pilot" the final mechanical properties of the material. Starting from the same material, and performing straightening more or less energetically, differences in the yield stress of 25-35 MPa can be obtained.

For example, starting from a coil with a yield stress of 400 MPa before unwinding, it is possible to produce, by varying only the straightening parameters, bars or brackets with yield stress between 450 and 480 MPa after ageing.

In practice, the end user can decide the properties of the end product according to his needs while remaining within the international standards concerning ultimate elongation requirements.

A further advantage with respect to the material obtained via the bed process is considerable reduction in the space required on the cooling line and a reduction in the time for obtaining the treated product.

The coil straightening phase, in addition to work hardening of the material, also involves a slight elongation of the rolled product.

The possibilities of adjustment of the process, in terms of cooling duration and intensity, permit the treatment of different diameters in order to obtain the same mechanical and quality characteristics on different dimensional categories of products.

The difference in mechanical properties of the first and last layer of the coil, resulting from the fact that these layers cool much quicker than the other parts, could be a limit to the process. To overcome this problem the flexibility of the cooling line is exploited by winding the first and last layer of the coil at a temperature of 670-680° C., as against 620° C. for the other coil layers. In this way coils are obtained which, in addition to complying with regulations, have very low standard deviations in terms of mechanical properties; in other words, the surface and inner layers have very similar mechanical properties.

The final temperature range at which the rolled product is wound in the form of a coil is fairly wide and can vary from 550 to 700° C.: corresponding to this range, yield stress values of between 400 and 520 Mpa are obtained.

Variations can be made to the method described above, while remaining within the scope of the invention. It applies to many other classes of steel, medium and high carbon, microalloys and alloys. For each different case, an appropriate number of water boxes and appropriate temperature ranges are provided.

The invention claimed is:

1. Coil winding method for metal bars after a rolling process which provides, at the rolling mill outlet (2), the following stages:

a) cooling of the bar by means of a first water box (4') to a second pre-established temperature higher than the temperature at which martensite begins to form;

b) performing equalisation in air up to a temperature of between 800° C. and 880° C. and surface tempering;

c) cooling by means of one or more water boxes (4", 4'''), with the product surface dropping below the temperature at which martensite begins to form;

d) performing equalisation in air, after each of said water boxes (4", 4'''), in corresponding stages, to respective pre-established equalised temperatures, wherein the equalisation, after the last of said water boxes (4"), is performed up to a temperature of between 600° C. and 700° C.;

e) winding of the bar in the form of a compact coil by means of coil winder (5) at a temperature of between 600° C. and 700° C., wherein a first and a last layer of the coil are wound at a temperature higher than the other coil layers;

f) cooling the bar in the form of a coil slowly so as to cause tempering of the bainite and martensite formed on the surface of the bar;

g) straightening the bar wound in the form of a compact coil; and h) ageing naturally the bar, by maintaining the bar at ambient temperature.

2. The method according to claim 1, wherein at stage g) the straightening is performed by unwinding the compact coil.

* * * * *